US006079299A

United States Patent [19]

Sundström

[11] Patent Number: 6,079,299

[45] Date of Patent: Jun. 27, 2000

[54] WRENCH HAVING A SOCKET WITH CIRCUMFERENTIALLY SPACED RECESSES

[75] Inventor: Erik Sundström, Sandviken, Sweden

[73] Assignee: Sandvik Aktiebolag, Sandviken, Sweden

[21] Appl. No.: 09/216,880

[22] Filed: Dec. 21, 1998

[30] Foreign Application Priority Data

Dec. 19, 1997 [SE] Sweden ..... 9704748

[51] Int. Cl.[7] ..... B25B 13/06

[52] U.S. Cl. ..... 81/121.1; 81/186

[58] Field of Search ..... 81/119, 121.1, 81/124.6, 186

[56] References Cited

U.S. PATENT DOCUMENTS 3,125,910 3/1964 Kavalar .
3,273,430 9/1966 Knudsen et al. .
4,512,220 4/1985 Barnhill, III et al. ..... 81/121.1
4,581,957 4/1986 Dossier .
4,882,957 11/1989 Wright et al. ..... 81/121.1
5,219,392 6/1993 Ruzicka et al. ..... 81/121.1
5,279,190 1/1994 Goss et al. ..... 81/121.1

*Primary Examiner*—David A. Scherbel
*Assistant Examiner*—Joni B. Danganan
*Attorney, Agent, or Firm*—Burns, Doane, Swecker & Mathis, L.L.P.

[57] ABSTRACT

A wrench includes an opening having a side wall defined by circumferentially alternating contact surfaces and recesses. Each recess includes a concave bottom surface and a pair of concave edge surfaces extending from respective ends of the bottom surface. The bottom surface has a radius of curvature larger than a radius of curvature of the edge surfaces and smaller than a distance from a center of the opening to a midpoint of the bottom surface, whereby a thickness of the wrench increases progressively on opposite sides of a midpoint of the bottom surface. Imaginary extensions of the contact surfaces disposed at opposite ends of each recess intersect one another substantially at the midpoint of the bottom surface.

7 Claims, 3 Drawing Sheets

WRENCH HAVING A SOCKET WITH CIRCUMFERENTIALLY SPACED RECESSES

BACKGROUND OF THE INVENTION

The present invention pertains to wrenches.

Wrenches, such as socket wrenches and box wrenches, have long been made with their inner corners shaped as rounded recesses to reduce the risk of cracks at the corners, where the thickness is small and the corners cause stress concentrations. Examples of this are described in U.S. Pat. Nos. 3,125,910, 3,273,430 and 4,581,957. Wrenches of these types are commonly used in mechanical power wrenches which often have an impact function when a preselected static torque value is exceeded. The stresses during the impacts can then reach high values and cause fatigue cracks in the wrenches if the corners are not rounded enough.

It is desirable that it be possible to use the wrench for nuts with worn or otherwise slightly differing profile. In that case it is important that the corners of the nut do not become overstressed and deformed, which is achieved by leaving them free of contact in the corner recesses. It is also desirable to avoid having sharp edges of the recesses cut into the surface of the nut, damaging the rust protection. This may be avoided by making the surface of the wrench slightly sloping as in U.S. Pat. No. 3,273,430, fully rounded as in U.S. Pat. No. 3,125,910, or both as in U.S. Pat. No. 4,581,957. One result of this is, however, that nuts with already deformed corners will be contacted near the center of the hexagon side, causing a reduced leverage and very large radial forces which may damage the wrench. It will also make the rotational contact very elastic, which will partly cancel the effect of the impact function.

The present invention concerns a type of socket wrenches, box wrenches or other fixed wrenches which reduces the stress concentration at the corners, and which will make a well defined contact far enough from the corners and from the rotation center, even when turning deformed nuts.

SUMMARY OF THE INVENTION

The present invention relates to a wrench for applying torque to a fastening element. The wrench includes an opening having a side wall defined by circumferentially alternating contact surfaces and recesses. Each recess includes a concave bottom surface and a pair of concave edge surfaces extending from respective ends of the bottom surface. The bottom surface has a radius of curvature larger than a radius of curvature of the edge surfaces, whereby a thickness of the wrench increases progressively on opposite sides of the bottom surface. Imaginary extensions of the contact surfaces disposed at opposite ends of each recess intersect one another substantially at the midpoint of the bottom surface.

BRIEF DESCRIPTION OF THE DRAWINGS

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 1:
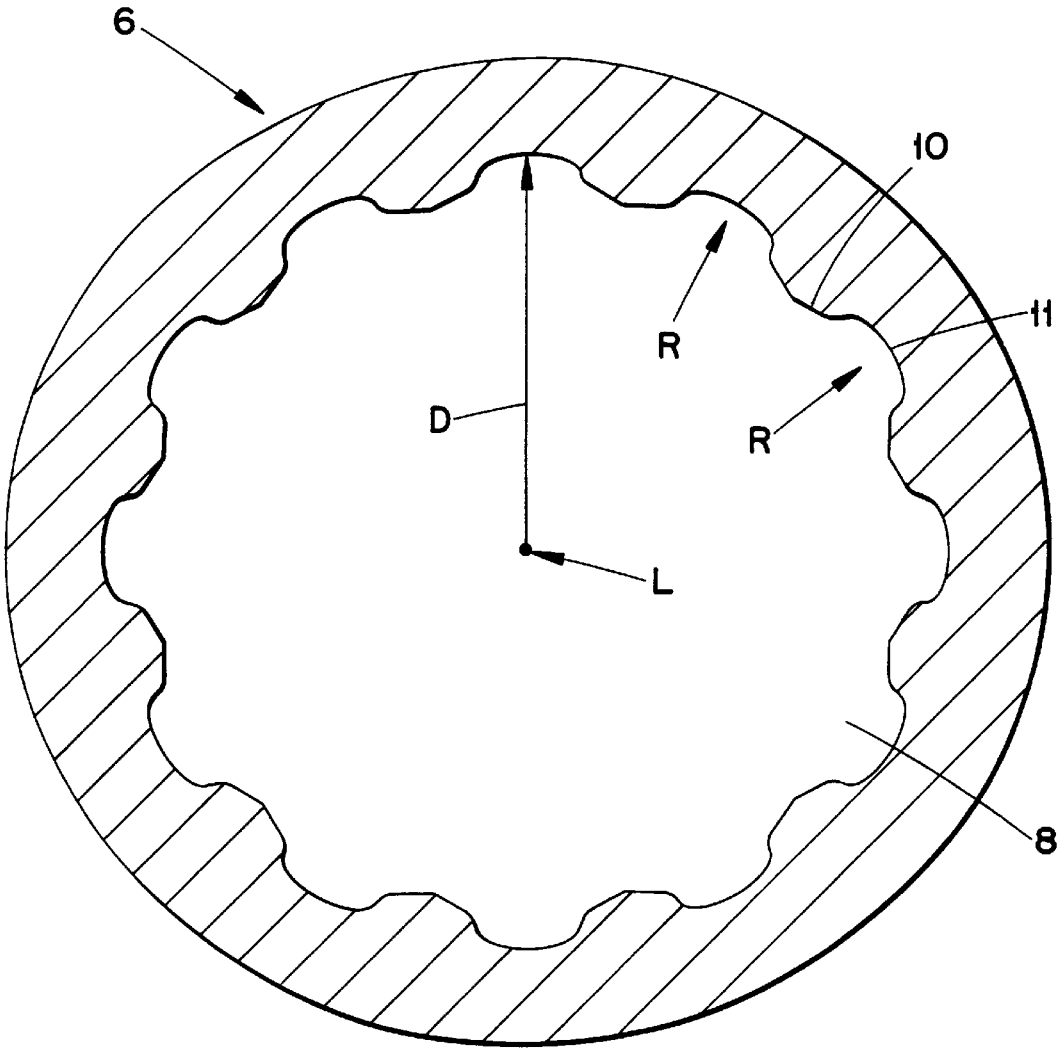
FIG. 1 is a cross-sectional view through a socket wrench according to the present invention.
Figure 2:
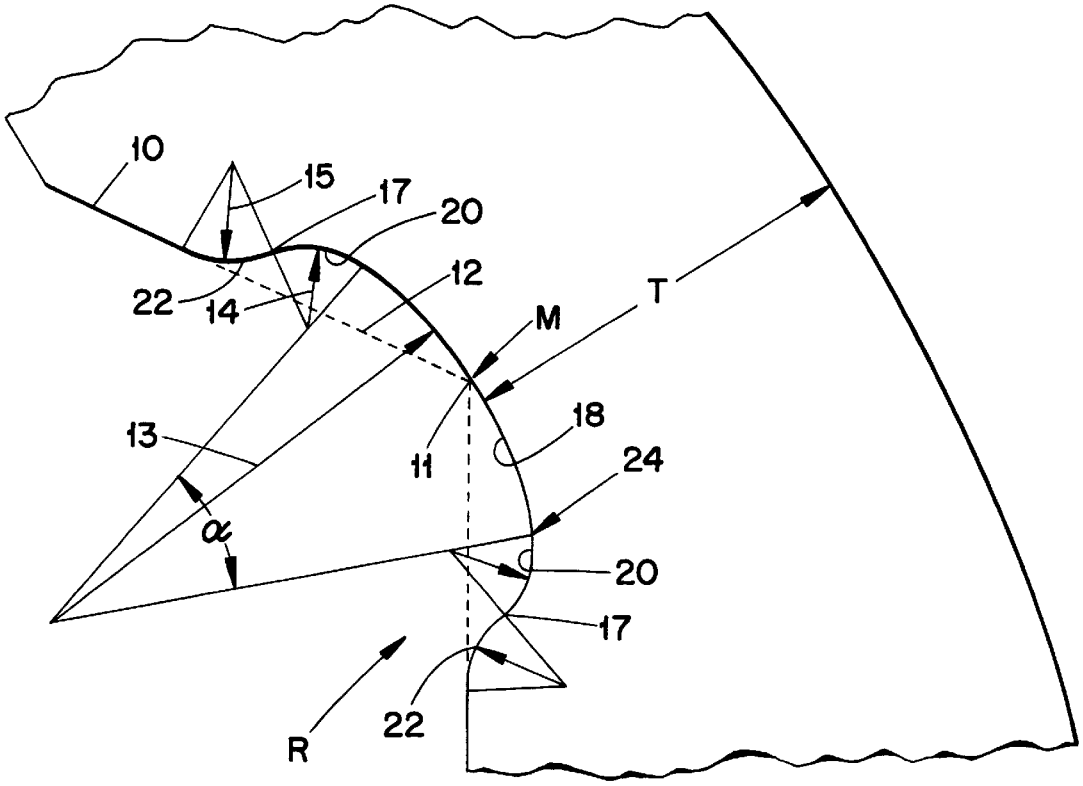
FIG. 2 is an enlarged fragmentary view of the wrench depicted in FIG. 1.
Figure 3:
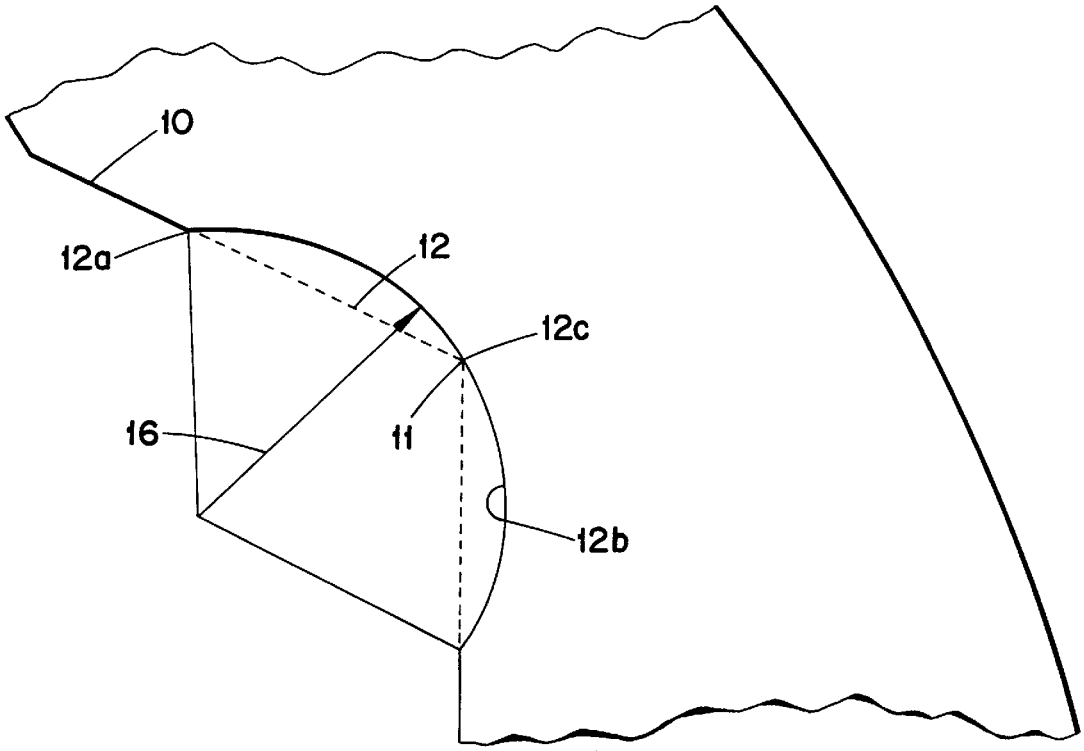
Fig. 3 (PRIOR ART)
FIG. 3 is a view similar to FIG. 2 of a conventional wrench.

A wrench profile is described with reference to FIG. 1 showing a section through a socket wrench (6) with rounded recesses R according to the invention, FIG. 2 showing a detail of a rounded recess at a corner according to the invention, and FIG. 3 showing a rounded recess at a corner according to U.S. Pat. No. 3,273,430.

The wrench (6) includes an opening (8) having a side wall formed by circumferentially alternating contact surfaces (10) and recesses R. The depth of the recess R should be such that it coincides with the nominal corner (11) of a hexagonal nut since damage to the corners of a nut will result in shortening or tangential deformation, not in radial expansion. For a given external diameter, this depth will allow the largest thickness at the corner.

FIG. 3 shows a recess according to U.S. Pat. No. 3,273,430 with a uniform radius of curvature (16) equal in length to the width (12) of one half of the recess. The width (12) comprises an extension of the contact surface (10) and is measured from one end **(12*a*) of a bottom surface (12*b*) of the recess to the midpoint (12*c*) of the bottom surface (12*b*). Since the stress concentration factor depends on the radius, it can be clearly reduced by giving the recess an overall oval or elliptical section according to FIG. 2, where the recess has a radiused concave bottom surface (18) extending for an angle $\alpha$ of about 40 degrees, and a pair of radiused 20 concave edge surfaces (20, 20). A pair of radiused convex transition surfaces (22, 22) interconnect respective edge surfaces (20, 20) with the contact surfaces (10). There is a transition point 24 where the bottom surface (18) joins each of the edge surfaces (20), and a transition point (17) where each edge surface (20) joins its respective transition surface (22). The width (12) of one-half of the 25 recess is defined by an imaginary line forming an extension of a contact surface (10) and intersecting the midpoint M of the bottom surface (18). The bottom surface (18) occupies a greater portion of the recess than both of the edge surfaces (20** combined.

The radius (13) of the bottom surface of the recess is 30–70% larger than the width (12), preferably 40–50% larger, and the edge surfaces (20) have a radius (14) that is 40–70% smaller most preferably 50–60% shorter, than the width (12) whereby the thickness T of the wrench begins to become considerably larger from the transition point (24) to the transition point (17). This allows a reduction of stresses of approximately 9% compared to the section according to FIG. 3, in spite of the wrench having a generally uniform thickness T along the bottom surface (18).

The transition point (24) between the radius of curvature (13) of the bottom surface and the smaller (14) radius of curvature of each edge surface may occur stepwise or gradually. The larger radius of curvature (13) should be at the bottom of the recess, and should be larger than the width (12) and less than the distance D from the center line L of the socket to the midpoint M. At increasing distance from the transition point (24) to the transition point (17), the thickness T will increase at a rate causing a decrease in the tangential stress and the bending stress without correction of the stress concentration factor. This allows a limited increase of the concentration factor at the transition point (24) to the smaller radius (14), while still keeping the stress approximately the same as at the bottom surface. Compared to a constant radius (16), the improvement is 8–10%. If the stresses are determined by an external deformation rather than by external torque, the improvement will be even higher, since the deformation is distributed over a longer portion.

In the prior art, e.g., U.S. Pat. No. 3,273,430, the transition to the active contact surface (10) is often made as a sharp corner, which may cause some damage to nuts, especially if they are made with rust protection coatings such as zinc or chrome. The contact surface is often made with an outward slope of 2–3 degrees so as not to damage nuts with smaller width, but will instead cause the forces to act too near the center of oversize nuts, causing very high forces and stresses in the wrench. Sharp corners are also difficult to forge and their forging tools are easily damaged.

A rounded transition at the contact surface (10) is also previously known, as in U.S. Pat. No. 3,125,910, where the radius of such a transition is as large as in the recess. This has two disadvantageous effects: the recess becomes unnecessarily narrow unless the contact point is far away from the corner of the nut, and the friction against painted or greasy nuts is low. Both effects cause high stresses in the wrench.

According to the present invention, the contact surface (10) close to the recess has a rounded transition surface (22) with a radius (15) smaller than the width (12), preferably 40–70% smaller. This leads to a well defined point of attack of the force between the wrench and the nut, and a contact which is concentrated enough to get a sure grip on painted surfaces but not enough to damage metal coatings. The transition (17) between the transition surface (22) and the edge surface (20) is smooth and continuous.

In the figures, the invention has been described as it is applied to wrenches with a closed hexagonal or dodecagonal profile, but it can also be applied to other wrench types such as open or semi-open wrenches, where the bending-stresses at the profile corners determine the strength.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A wrench for applying torque to a fastening element, the wrench including an opening having a side wall defined by circumferentially alternating contact surfaces and recesses, each recess including a concave bottom surface and a pair of concave edge surfaces extending from respective ends of the bottom surface, the bottom surface having a radius of curvature larger than a radius of curvature of the edge surfaces whereby a thickness of the wrench increases progressively on opposite sides of the bottom surface, wherein extensions of the contact surfaces disposed at opposite ends of each recess intersect one another substantially at the midpoint of the bottom surface.

2. The wrench according to claim 1 wherein a radius of the bottom surface is 30–70% longer than a length of each of the extensions, and the radius of each edge surface is 40–70% shorter than such length.

3. The wrench according to claim 2 further including a convex radiused transition surface extending between each edge surface and an adjacent contact surface, a radius of the transition surface being 40–70% shorter than the length of the imaginary extension.

4. The wrench according to claim 3 wherein a transition between the transition surface and an adjacent edge surface is smooth and continuous.

5. The wrench according to claim 1 wherein the radius of the bottom surface is 40–50% longer than the length of the extension, and the radius of the edge surface is 50–60% shorter than such length.

6. The wrench according to claim 1 wherein the bottom surface occupies a greater portion of the recess than both of the edge surfaces combined.

7. The wrench according to claim 1 wherein the radius of the bottom surface is shorter than a distance from a center of the opening to a midpoint of the bottom surface.

* * * * *